United States Patent [19]

Campbell

[11] Patent Number: 4,850,482

[45] Date of Patent: Jul. 25, 1989

[54] CIGARETTE BOX INNERFRAME

[75] Inventor: Christopher J. Campbell, Midlothian, Va.

[73] Assignee: Philip Morris Incorporated, New York, N.Y.

[21] Appl. No.: 205,317

[22] Filed: Jun. 10, 1988

[51] Int. Cl.[4] ..... B65D 85/10; B65D 5/48

[52] U.S. Cl. ..... 206/273; 206/271; 206/268; 229/160.1

[58] Field of Search ..... 206/268, 271, 273; 229/146, 160.1

[56] References Cited

U.S. PATENT DOCUMENTS

| | | | |
|---|---|---|---|
| 949,176 | 12/1910 | L'Enfant | 425/311 |
| 1,253,219 | 1/1918 | Dula | 206/256 |
| 1,582,655 | 4/1926 | Anderegg | 220/441 |
| 1,806,905 | 5/1931 | Kampfman | 206/252 |
| 1,867,949 | 7/1932 | Molins | 206/273 X |
| 2,803,391 | 8/1957 | Koeble | 229/27 |
| 2,820,545 | 1/1958 | Bramhill | 206/41 |
| 2,922,565 | 1/1960 | Roderick et al. | 229/44 |
| 2,944,555 | 7/1960 | Peel et al. | 131/238 |
| 3,058,581 | 10/1962 | Keating | 206/41 |
| 3,081,867 | 3/1963 | Corey | 206/41 |
| 3,489,272 | 1/1970 | Rosen | 206/48.5 |
| 3,536,246 | 10/1970 | Rosen | 229/16 |
| 3,752,308 | 8/1973 | Begemann | 206/273 X |
| 4,081,126 | 3/1978 | Barnard | 229/160.1 X |
| 4,241,827 | 12/1980 | Focke | 206/248 |
| 4,771,882 | 9/1988 | Lowe et al. | 206/268 |
| 4,793,478 | 12/1988 | Tudor | 206/256 |

FOREIGN PATENT DOCUMENTS

| | | |
|---|---|---|
| 938974 | 10/1948 | France . |
| 193808 | 1/1938 | Switzerland . |
| 522469 | 6/1940 | United Kingdom . |

OTHER PUBLICATIONS

"Packaging of Cigarettes", Disclosure 88/5, *Tobacco Patents Information Bulletin, vol. 88, No. 35-36, Sep. 2, 1988.*

*Primary Examiner*—John Rivell

*Attorney, Agent, or Firm*—Doreen F. Shulman

[57] ABSTRACT

A paperboard innerframe for insertion into a cigarette box is provided. The innerframe allows a bundle of smaller than standard size cigarettes or a bundle of a small number of standard size cigarettes to be retained securely in a cigarette box that is larger than necessary to hold a bundle of such cigarettes exactly. The innerframe has a front panel, outer side panels, inner side panels, a back panel, a concealing flap and tapering tabs.

29 Claims, 3 Drawing Sheets

CIGARETTE BOX INNERFRAME

BACKGROUND OF THE INVENTION

This invention relates to cigarette boxes, and particularly to an innerframe inserted into a cigarette box for securely retaining a bundle of smaller than standard size cigarettes or a bundle of a small number of standard size cigarettes in the cigarette box.

In the past, cigarettes were generally made with standard circumferences of about 24.8 millimeters and were usually packaged in bundles of twenty cigarettes. Recently, thinner cigarettes of about 17 millimeters have increased in popularity. When the usual quantity of twenty smaller than standard size cigarettes are arranged in a configuration of two rows of ten, this cigarette bundle could be packaged in a very small cigarette box designed to hold exactly that selected number of cigarettes in that selected configuration. However, for tax stamping, package manufacturing and aesthetic reasons, it may be desirable to package a bundle of smaller than standard size cigarettes in a larger box than is necessary to hold such a cigarette bundle.

Conventional tax stamping machinery is designed to apply a tax stamp to each of ten standard size cigarette boxes contained in a standard size cigarette carton by stamping the boxes located at known fixed positions within the relatively close-fitting carton. A standard size cigarette box holds twenty standard size cigarettes arranged in a configuration of three rows of seven, six and seven cigarettes. A standard size cigarette carton holds ten standard size cigarette boxes arranged in a configuration of two rows of five. Thus, tax stamps, required by state laws, could not be applied to boxes designed to hold exactly twenty smaller than standard size cigarettes in a configuration of two rows of ten using conventional tax stamping machinery. Although this problem could be solved by designing new tax stamping machinery specifically for very small cigarette boxes, it is more economical and efficient to continue to use conventional tax stamping machinery. By packaging smaller than standard size cigarettes in a larger box than is necessary to hold a bundle of such cigarettes, and placing these boxes securely in a standard size cigarette carton at known, fixed positions within that carton, existing machinery could be used to apply tax stamps.

In addition, machinery for manufacturing cigarette boxes for securely retaining a bundle of twenty standard size cigarettes in a configuration of three rows of seven, six and seven cigarettes and a bundle of fourteen standard size cigarettes in a configuration of two rows of seven already exists. It is more economical and efficient to package bundles of smaller than standard size cigarettes in larger boxes than are necessary to hold such a bundle when such packages can be manufactured on existing machinery.

Packaging bundles of smaller than standard size cigarettes in larger boxes than are necessary to hold such bundles exactly is also desirable for aesthetic reasons. It is believed that smokers would prefer the size and shape of such larger boxes.

Smaller than standard size cigarettes have previously been securely retained in larger cigarette boxes by the insertion of bulky spacer material, corrugated cardboard for example, in the back of the larger cigarette box. However, this bulky spacer material is difficult to handle and store, and requires new or significantly modified machinery for packaging the smaller than standard size cigarettes in larger cigarette boxes. Hence, a means is required for securely retaining a bundle of smaller than standard size cigarettes in a cigarette box that is larger than the exact size needed to retain such a bundle without the addition of bulky spacer material and using existing packaging machinery.

Additionally, although cigarette boxes for securely retaining a bundle of twenty standard size cigarettes in a configuration of three rows of seven, six and seven cigarettes and a bundle of fourteen standard size cigarettes in a configuration of two rows of seven already exists, it is desirable to retain securely a bundle of a smaller number of standard size cigarettes in a larger box than is necessary to hold such a cigarette bundle exactly. It is more economical and efficient to package bundles of a smaller number of standard size cigarettes in larger boxes than are necessary to hold such a bundle exactly, when such packages can be manufactured on existing machinery. Although such a bundle could be securely retained in larger cigarette boxes by the insertion of bulky spacer material, corrugated cardboard for example, in the back of the larger cigarette box, this bulky spacer material would be difficult to handle and store, and would require new or significantly modified machinery for packaging bundles of a smaller number of standard size cigarettes in larger cigarette boxes. Hence, a means is required for securely retaining a bundle of a smaller number of standard size cigarettes in a larger box than is necessary to hold such a cigarette bundle exactly without the addition of bulky spacer material and using slightly modified existing packaging machinery.

SUMMARY OF THE INVENTION

It is an object of this invention to provide an innerframe for a cigarette box larger than is necessary for holding a bundle of smaller than standard size cigarettes exactly so as to allow tax stamps to be applied, using conventional tax stamping machinery, on cigarette boxes holding a bundle of smaller than standard size cigarettes.

It is also an object of this invention to provide an innerframe for a cigarette box larger than is necessary for holding a bundle of smaller than standard size cigarettes exactly so as to allow a bundle of such cigarettes to be packaged in boxes that can be manufactured on existing machinery.

It is also an object of this invention to provide an innerframe for a cigarette box larger than is necessary for holding a bundle of smaller than standard size cigarettes exactly so as to allow a bundle of such cigarettes to be packaged in a box that is believed to be more aesthetically desirable to smokers.

It is also an object of this invention to provide an innerframe for a cigarette box larger than is necessary for holding a bundle of a smaller number of standard size cigarettes exactly so as to allow a bundle of such cigarettes to be packaged in boxes that can be manufactured on existing machinery.

In accordance with the invention an innerframe for insertion into a cigarette box is provided. The innerframe is folded from a blank and is inserted into a cigarette box during the packaging process. The innerframe creates a space within a cigarette box larger than is necessary for holding a bundle of smaller than standard size cigarettes or a bundle of a smaller number of standard size cigarettes exactly for securely retaining a bundle of such cigarettes within the larger box. The innerframe has a front panel with a cutout portion through which cigarettes may be withdrawn, outer side panels, inner side panels, and a back panel. The inner side panels have a width smaller than the outer side panels so that the difference in width generally equals the thickness of a selected number of cigarettes arranged in a selected configuration. The innerframe also has a concealing flap that adds rigidity to the innerframe, covers the space created by the innerframe between the back wall of the box and the back panel of the innerframe, and keeps dust out of the aforementioned space. The innerframe also has tapering tabs that hold down the concealing flap and facilitate closure of the cigarette box.

BRIEF DESCRIPTION OF THE DRAWINGS

The above and other objects and advantages of the invention will be apparent from consideration of the following detailed description, taken in conjunction with the accompanying drawings, in which like reference characters refer to like parts throughout, and in which.

DETAILED DESCRIPTION OF THE PREFERRED EMBODIMENT

Figure 1:
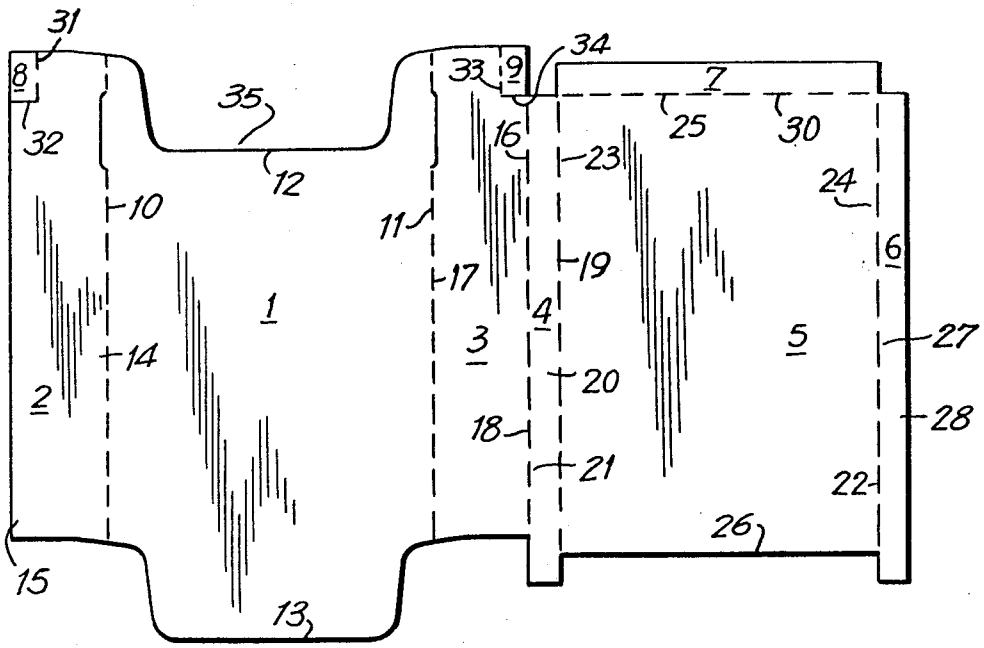
FIG. 1 is a plan view of a preferred embodiment of a blank according to this invention in its unerected state.

A preferred embodiment of the present invention is shown in FIGS. 1–6. The innerframe is erected from a paperboard blank as shown in FIG. 1. The blank comprises a front panel 1, a first outer side panel 2, a second outer side panel 3, a first inner side panel 4, a back panel 5, a second inner side panel 6, a concealing flap 7, a first tapering tab 8 and a second tapering tab 9. The front panel 1 is defined by a left long front perforated line 10, a right long front perforated line 11, a top front panel margin 12 and a bottom front panel margin 13. The front panel 1 also has a cutout portion 35 at the top front panel margin 12 that forms an opening through which cigarettes may be withdrawn. The first outer side panel 2 is connected to the front panel 1 along the left long front perforated line 10 and is further defined by a front first outer side panel margin 14 and a back first outer side panel margin 15. The first outer side panel 2 also has a first tapering tab 8. The first tapering tab 8 is defined by a vertical first outer side panel tab perforated line 31 and a horizontal first outer side panel tab cut line 32 that intersect at a corner opposite the left long front perforated line 10. The second outer side panel 3 is connected to the front panel 1 along the right long first perforated line 11 and is further defined by a first long first inner side perforated line 16 that is parallel to the right long front perforated line 11, a front second outer side panel margin 17 and a back second outer side panel margin 18. The second outer side panel 3 also has a second tapering tab 9. The second tapering tab 9 is defined by a vertical second outer side panel tab perforated line 33 and a horizontal second outer side panel tab cut line 34 that intersect at a corner opposite the right long front perforated line 11. The first inner side panel 4 is connected to the second outer side panel 3 along the first long first inner side perforated line 16 and is further defined by a second long first inner side perforated line 19 that is parallel to the first long first inner perforated line 16, a front first inner side panel margin 20 and a back first inner side panel margin 21. The back panel 5 is connected to the first inner side panel 4 along the second long first inner side perforated line 19 and is further defined by a long back perforated line 22 that is parallel to the second long first inner side perforated line 19, a left back panel margin 23, a right back panel margin 24, a top back panel margin 25 and a bottom back panel margin 26. The concealing flap 7 is attached to the back panel 5 along the back top concealing flap perforated line 30 that is perpendicular to the long back perforated line 22. The second inner side panel margin 6 is connected to the back panel 5 along the long back perforated line 22 and is further defined by a front second inner side panel margin 27 and a back second inner side panel margin 28.

The first inner side panel 4 and the second inner side panel 6 have a width that is smaller than the width of the first outer side panel 2 and the second outer side panel 3, so that the difference in width generally equals the thickness of a selected number of cigarettes arranged in a selected configuration.

Figure 2:
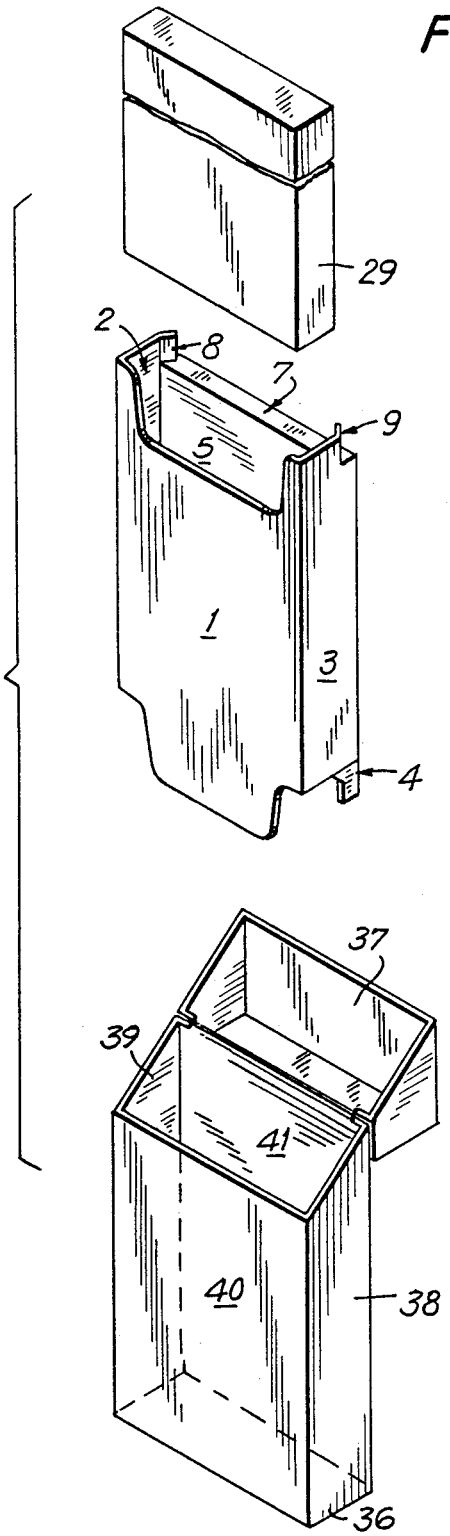
FIG. 2 is a perspective view of a bundle of cigarettes, an innerframe erected from the blank depicted in FIG. 1 and a cigarette box into which the innerframe and cigarette bundle are inserted.

The blank shown in FIG. 1 is erected to form the innerframe shown in FIG. 2. The first outer side panel 2 and the second outer side panel 3 are erected perpendicular to the front panel 1 by folding the left long front perforated line 10 and the right long front perforated line 11. The first inner side panel 4 is erected adjacent to the second outer side panel 3 by folding the first long first inner side perforated line 16. The back panel 5 is erected perpendicular to the second outer side panel 3 and the first inner side panel 4 by folding the second long first inner side perforated line 19. The second inner side panel 6 is erected perpendicular to the back panel 5 and adjacent to the first outer side panel 2 by folding the long back perforated line 22. The concealing flap 7 is erected perpendicular to the back panel 5 by folding the back top concealing flap perforated line 30. The first tapering tab 8 and the second tapering tab 9 are erected by folding the vertical first outer side panel tab perforated line 31 and the vertical second outer side panel tab perforated line 33, respectively.

Figure 3:
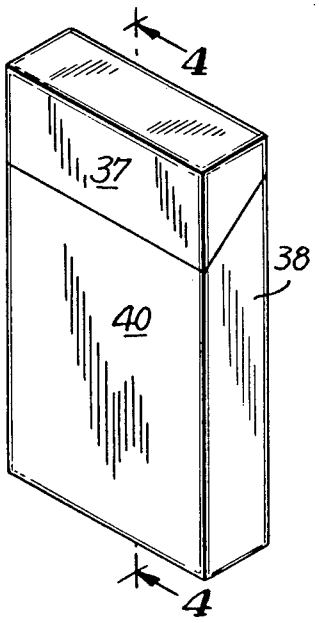
FIG. 3 is a perspective view of an erected cigarette box containing an erected innerframe and a cigarette bundle.
Figure 4:
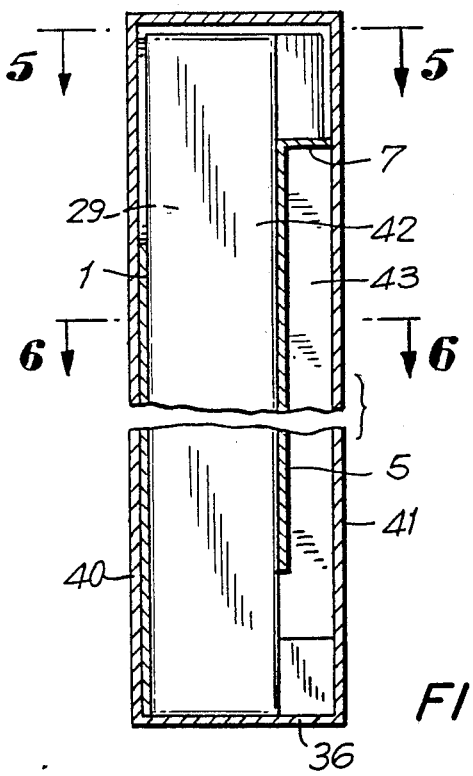
FIG. 4 is a sectional view of an erected cigarette box containing an erected innerframe and a cigarette bundle taken along line 4—4 of FIG. 3.

The cigarette box shown in FIGS. 2, 3 and 4 receives the innerframe as shown in FIG. 2. The cigarette box of FIGS. 2, 3 and 4 has a bottom box panel 36, a top lid box panel 37, a right side box panel 38, an opposing left side box panel 39, a front box panel 40 and a back box panel 41. The erected innerframe is inserted and adhesively attached to the cigarette box so that the front panel 1 is contiguous with the front box panel 40, the second outer side panel 3 is contiguous with the right side box panel 38, the first outer side panel 2 is contiguous with the left side box panel 39, the back first inner side panel margin 21 and the back second outer side panel margin 18 touch the back box panel 41, the back second inner side panel margin 28 and the back first outer side panel margin touch the back box panel 41 and the back panel 5 is separated from the back box panel 41 by a distance equal to the width of the first inner side panel 4 or the second inner side panel 6.

Figure 5:
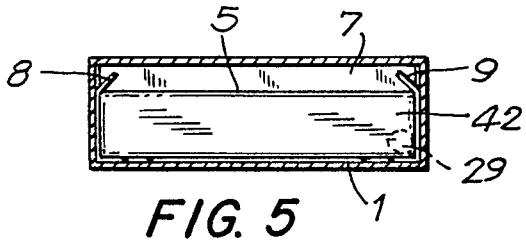
FIG. 5 is a sectional view of an erected cigarette box containing an erected innerframe and a cigarette bundle showing tapering tabs and a concealing flap, taken along line 5—5 of FIG. 4.
Figure 6:
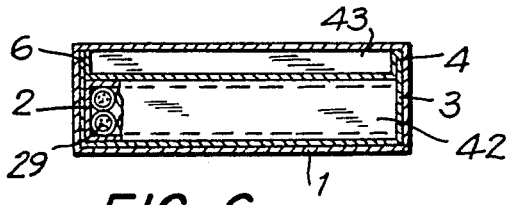
FIG. 6 is a sectional view of an erected cigarette box containing an erected innerframe and a cigarette bundle, taken along line 6—6 of FIG. 4.

As shown in FIGS. 4, 5 and 6, when the innerframe is inserted into a cigarette box that is larger than is necessary for holding a bundle of smaller than standard size cigarettes 29 or a bundle of a smaller number of standard size cigarettes 29 exactly, the innerframe creates a space 42 between the front panel 1 and the back panel 5 within that cigarette box for securely retaining a bundle of such cigarettes 29 within the larger box. The concealing flap 7 as shown in FIGS. 4 and 5, adds rigidity to the innerframe, covers the space 43 created by the innerframe between the back box panel 41 and the back panel 5, and keeps dust out of that space 43. The first tapering tab 8 and the second tapering tab 9 as shown in FIG. 5, hold down the concealing flap 7 and facilitate closure of the cigarette box.

The innerframe described herein provides a means for securely retaining a bundle of smaller than standard size cigarettes or a bundle of a smaller number of standard size cigarettes in a box that is larger than necessary for holding such a cigarette bundle exactly.

It will be apparent to those skilled in the art that the invention described herein can be practiced by other than the embodiments described above, which are presented for the purpose of illustration and not of limitation, and the present invention is limited only by the claims which follow.

I claim:

1. A blank for forming an innerframe for insertion into a cigarette box for securely retaining a bundle of cigarettes within the cigarette box, the blank comprising:

a front panel defined by a pair of parallel right and left long front score lines and top and bottom front panel margins;

a first outer side panel, substantially rectangular in shape, connected to the front panel along the left long front score line and further defined by front and back first outer side panel margins;

a second outer side panel, substantially rectangular in shape, connected to the front panel along the right long front score line, and further defined by a first long first inner side score line parallel to the right long front score line and front and back second outer side panel margins;

a first inner side panel connected to the second outer side panel along the first long first inner side score line, and further defined by a second long first inner side score line parallel to the first long first inner side score line and front and back first inner side panel margins;

a back panel connected to the first inner side panel along the second long first inner side score line and further defined by a long back score line parallel to the second long first inner side score line and left, right, top and bottom back panel margins;

a second inner side panel connected to the back panel along the long back score line, and further defined by front and back second inner side panel margins; and the first and second inner side panels having a width smaller than the first and second outer side panels so that the difference in width generally equals the thickness of a selected number of cigarettes arranged in a selected configuration.

2. The blank of claim 1 wherein the right and left long front score lines, the first long first inner side score line, the second long first inner side score line and the long back score line are perforated.

3. The blank of claim 1 wherein the right and left long front score lines are folded to erect the first outer side panel and the second outer side panel perpendicular to the front panel, the first long first inner side score line is folded to erect the first inner side panel adjacent to the second outer side panel, the second long first inner side score line is folded to erect the back panel perpendicular to the second outer side panel and the first inner side panel, the long back score line is folded to erect the second inner side panel perpendicular to the back panel and adjacent to the first outer side panel.

4. The blank of claim 1 wherein a concealing flap is attached to the top of the back panel along a back top concealing flap score line perpendicular to the long back score line.

5. The blank of claim 4 wherein the back top concealing flap score line is perforated.

6. The blank of claim 4 wherein the back top concealing flap score line is folded to erect the concealing flap perpendicular to the back panel.

7. The blank of claim 1 wherein the first outer side panel further comprises a first tapering tab defined by a vertical first outer side panel tab score line and a horizontal first outer side panel tab score line, the vertical first outer side panel tab score line and the horizontal first outer side panel tab score line intersecting at a corner opposite the left long front score line and the second outer side panel further comprises a second tapering tab defined by a vertical second outer side panel tab score line and a horizontal second outer side panel tab score line, the vertical second outer side panel tab score line and the horizontal second outer side panel tab score line intersecting at a corner opposite the right long front score line.

8. The blank of claim 7 wherein the vertical first outer side panel tab score line and the vertical second outer side panel tab score line are perforated and the horizontal first outer side panel score line and the horizontal second outer side panel score line are cut.

9. The blank of claim 8 wherein the vertical first outer side panel tab score line and the vertical second outer side panel tab score line are folded to form the first tapering tab and the second tapering tab, respectively.

10. The blank of claim 1 wherein the front panel is further defined by a cutout portion at the top margin thereof forming an opening through which cigarettes may be withdrawn.

11. The blank of claim 1 wherein the blank is made of paperboard.

12. An innerframe for insertion into a cigarette box, the cigarette box having a bottom box panel, a top lid box panel, opposing right and left side box panels and opposing front and back box panels, the innerframe for securely retaining a bundle of cigarettes within the cigarette box, the innerframe comprising:

a front panel defined by a pair of parallel right and left long front score lines and top and bottom front panel margins;

a first outer side panel, substantially rectangular in shape, connected to the front panel along the left long front score line and further defined by front and back first outer side panel margins;

a second outer side panel, substantially rectangular in shape, connected to the front panel along the right long front score line, and further defined by a first long first inner side score line parallel to the right long front score line and front and back second outer side panel margins;

a first inner side panel connected to the second outer side panel along the first long first inner side score line, and further defined by a second long first inner side score line parallel to the first long first inner side score line and front and back first inner side panel margins;

a back panel connected to the first inner side panel along the second long first inner side score line and further defined by a long back score line parallel to the second long first inner side score line and left, right, top and bottom back panel margins;

a second inner side panel connected to the back panel along the long back score line, and further defined by front and back second inner side panel margins; and the first and second inner side panels having a width smaller than the first and second outer side panels so that the difference in width generally equals the thickness of a selected number of cigarettes arranged in a selected configuration wherein the innerframe is erected and inserted into the cigarette box so that the front panel is contiguous with the front box panel, the second outer side panel is contiguous with the right side box panel, the first outer side panel is contiguous with the left side box panel, the back first inner side panel margin and the back second outer side panel margin touch the back box panel, the back second inner side panel margin and the back first outer side panel margin touch the back box panel, and the back panel is separated from the back box panel by a distance equal to the width of the first and second inner side panels.

13. A cigarette box, the cigarete box comprising:

a bottom box panel;

a top lid box panel;

opposing right and left side box panels;

opposing front and back box panels; and an innerframe for insertion into the cigarette box for securely retaining a bundle of cigarettes within the cigarette box, the innerframe further comprising:

a front panel defined by a pair of parallel right and left long front score lines and top and bottom front panel margins;

a first outer side panel, substantially rectangular in shape, connected to the front panel along the left long front score line and further defined by front and back first outer side panel margins;

a second outer side panel, substantially rectangular in shape, connected to the front panel along the right long front score line, and further defined by a first long first inner side score line parallel to the right long front score line and front and back second outer side panel margins;

a first inner side panel connected to the second outer side panel along the first long first inner side score line, and further defined by a second long first inner side score line parallel to the first long first inner side score line and front and back first inner side panel margins;

a back panel connected to the first inner side panel along the second long first inner side score line and further defined by a long back score line parallel to the second long first inner side score line and left, right, top and bottom back panel margins;

a second inner side panel connected to the back panel along the long back score line, and further defined by front and back second inner side panel margins; and the first and second inner side panels having a width smaller than the first and second outer side panels so that the difference in width generally equals the thickness of a selected number of cigarettes arranged in a selected configuration wherein the innerframe is erected and inserted into the cigarette box so that the front panel is contiguous with the front box panel, the second outer side panel is contiguous with the right side box panel, the first outer side panel is contiguous with the left side box panel, the back first inner side panel margin and the back second outer side panel margin touch the back box panel, the back second inner side panel margin and the back first outer side panel margin touch the back box panel, and the back panel is separated from the back box panel by a distance equal to the width of the first and second inner side panels.

14. The innerframe of claim 12 wherein the innerframe is adhesively attached to the cigarette box.

15. The innerframe of claim 12 wherein the right and left long front score lines, the first long first inner side score line, the second long first inner side score line and the long back score line are perforated.

16. The innerframe of claim 12 wherein the right and left long front score lines are folded to erect the first outer side panel and the second outer side panel perpendicular to the front panel, the first long first inner side score line is folded to erect the first inner side panel adjacent to the second outer side panel, the second long first inner side score line is folded to erect the back panel perpendicular to the second outer side panel and the first inner side panel, the long back score line is folded to erect the second inner side panel perpendicular to the back panel and adjacent to the first outer side panel.

17. The innerframe of claim 12 wherein a concealing flap is attached to the top of the back panel along a back top concealing flap score line perpendicular to the long back score line and further defined by a back concealing flap margin.

18. The innerframe of claim 17 wherein the back top concealing flap score line is perforated.

19. The innerframe of claim 17 wherein the back top concealing flap score line is folded to erect the concealing flap perpendicular to the back panel and the back concealing flap margin touches the top back panel margin.

20. The innerframe of claim 12 wherein the first outer side panel further comprises a first tapering tab defined by a vertical first outer side panel tab score line and a horizontal first outer side panel tab score line, the vertical first outer side panel tab score line and the horizontal first outer side panel tab score line intersecting at a corner opposite the left long front score line and the second outer side panel further comprises a second tapering tab defined by a vertical second outer side panel tab score line and a horizontal second outer side panel tab score line, the vertical second outer side panel tab score line and the horizontal second outer side panel tab score line intersecting at a corner opposite the right long front score line.

21. The innerframe of claim 20 wherein the vertical first outer side panel tab score line and the vertical second outer side panel tab score line are perforated and the horizontal first outer side panel score line and the horizontal second outer side panel score line are cut.

22. The innerframe of claim 21 wherein the vertical first outer side panel tab score line and the vertical second outer side panel tab score line are folded to form the first tapering tab and the second tapering tab, respectively.

23. The innerframe of claim 12 wherein the front panel is further defined by a cutout portion at the top margin thereof forming an opening through which cigarettes may be withdrawn.

24. The innerframe of claim 12 wherein the innerframe is made of paperboard.

25. A blank for forming a paperboard innerframe for insertion into a cigarette box for securely retaining a bundle of cigarettes within the cigarette box, the blank comprising:

a front panel defined by a pair of parallel right and left long front perforated lines and top and bottom front panel margins, and further defined by a cutout portion at the top margin thereof forming an opening through which cigarettes may be withdrawn;

a first outer side panel, substantially rectangular in shape, connected to the front panel along the left long front perforated line and further defined by front and back first outer side panel margins;

the first outer side panel further comprises a first tapering tab defined by a vertical first outer side panel tab perforated line and a horizontal first outer side panel tab cut line, the vertical first outer side panel tab perforated line and the horizontal first outer side panel tab cut line intersecting at a corner opposite the left long front perforated line;

a second outer side panel, substantially rectangular in shape, connected to the front panel along the right long front perforated line, and further defined by a first long first inner side perforated line parallel to the right long front perforated line and front and back second outer side panel margins;

the second outer side panel further comprises a second tapering tab defined by a vertical second outer side panel tab perforated line and a horizontal second outer side panel tab cut line, the vertical second outer side panel tab perforated line and the horizontal second outer side panel tab cut line intersecting at a corner opposite the right long front perforated line;

a first inner side panel connected to the second outer side panel along the first long first inner side perforated line, and further defined by a second long first inner side perforated line parallel to the first long first inner side perforated line and front and back first inner side panel margins;

a back panel connected to the first inner side panel along the second long first inner side perforated line and further defined by a long back perforated line parallel to the second long first inner side perforated line and left, right, top and bottom back panel margins;

a concealing flap attached to the top of the back panel along a back top concealing flap perforated line perpendicular to the long back perforated line;

a second inner side panel connected to the back panel along the long back perforated line, and further defined by front and back second inner side panel margins; and the first and second inner side panels having a width smaller than the first and second outer side panels so that the difference in width generally equals the thickness of a selected number of cigarettes arranged in a selected configuration.

26. The blank of claim 25 wherein the right and left long front perforated lines are folded to erect the first outer side panel and the second outer side panel perpendicular to the front panel, the first long inner side perforated line is folded to erect the first inner side panel adjacent to the second outer side panel, the second long first inner side perforated line is folded to erect the back panel perpendicular to the second outer side panel and the first inner side panel, the long back perforated line is folded to erect the second inner side panel perpendicular to the back panel and adjacent to the first outer side panel, the back top concealing flap perforated line is folded to erect the concealing flap perpendicular to the back panel, and the vertical first outer side panel tab perforated line and the vertical second outer side panel tab perforated line are folded to form the first tapering tab and second tapering tab, respectively.

27. A paperboard innerframe for insertion into a cigarette box, the cigarette box having a bottom box panel, a top lid box panel, opposing right and left side box panels and opposing front and back box panels, the innerframe for securely retaining a bundle of cigarettes within the cigarette box, the innerframe comprising:

a front panel defined by a pair of parallel right and left long front perforated lines and top and bottom front panel margins, and further defined by a cutout portion at the top margin thereof forming an opening through which cigarettes may be withdrawn;

a first outer side panel, substantially rectangular in shape, connected to the front panel along the left long front perforated line and further defined by front and back first outer side panel margins;

the first outer side panel further comprises a first tapering tab defined by a vertical first outer side panel tab perforated line and a horizontal first outer side panel tab cut line, the vertical first outer side panel tab perforated line and the horizontal first outer side panel tab cut line intersecting at a corner opposite the left long front perforated line;

a second outer side panel, substantially rectangular in shape, connected to the front panel along the right long front perforated line, and further defined by a first long first inner side perforated line parallel to the right long front perforated line and front and back second outer side panel margins;

the second outer side panel further comprises a second tapering tab defined by a vertical second outer side panel tab perforated line and a horizontal second outer side panel tab cut line, the vertical second outer side panel tab perforated line and the horizontal second outer side panel tab cut line intersecting at a corner opposite the right long front perforated line;

a first inner side panel connected to the second outer side panel along the first long first inner side perforated line, and further defined by a second long first inner side perforated line parallel to the first long first inner side perforated line and front and back first inner side panel margins;

a back panel connected to the first inner side panel along the second long first inner side perforated line and further defined by a long back perforated line parallel to the second long first inner side perforated line and left, right, top and bottom back panel margins;

a concealing flap attached to the top of the back panel along a back top concealing flap perforated line perpendicular to the long back perforated line;

a second inner side panel connected to the back panel along the long back perforated line, and further defined by front and back second inner side panel margins;

the first and second inner side panels having a width smaller than the first and second outer side panels so that the difference in width generally equals the thickness of a selected number of cigarettes arranged in a selected configuration; and the innerframe is adhesively attached to the cigarette box wherein the innerframe is erected and inserted into the cigarette box so that the front panel is contiguous with the front box panel, the second outer side panel is contiguous with the right side box panel, the first outer side panel is contiguous with the left side box panel, the back first inner side panel margin and the back second outer side panel margin touch the back box panel, the back second inner side panel margin and the back first outer side panel margin touch the back box panel, and the back panel is separated from the back box panel by a distance equal to the width of the first and second inner side panels.

28. A cigarette box, the cigarete box comprising:

a bottom box panel;

a top lid box panel;

opposing right and left side box panels;

opposing front and back box panels; and an innerframe for insertion into the cigarette box for securely retaining a bundle of cigarettes within the cigarette box, the innerframe further comprising:

a front panel defined by a pair of parallel right and left long front perforated lines and top and bottom front panel margins, and further defined by a cutout portion at the top margin thereof forming an opening through which cigarettes may be withdrawn;

a first outer side panel, substantially rectangular in shape, connected to the front panel along the left long front perforated line and further defined by front and back first outer side panel margins;

the first outer side panel further comprises a first tapering tab defined by a vertical first outer side panel tab perforated line and a horizontal first outer side panel tab cut line, the vertical first outer side panel tab perforated line and the horizontal first outer side panel tab cut line intersecting at a corner opposite the left long front perforated line;

a second outer side panel, substantially rectangular in shape, connected to the front panel along the right long front perforated line, and further defined by a first long first inner side perforated line parallel to the right long front perforated line and front and back second outer side panel margins;

the second outer side panel further comprises a second tapering tab defined by a vertical second outer side panel tab perforated line and a horizontal second outer side panel tab cut line, the vertical second outer side panel tab perforated line and the horizontal second outer side panel tab cut line intersecting at a corner opposite the right long front perforated line;

a first inner side panel connected to the second outer side panel along the first long first inner side perforated line, and further defined by a second long first inner side perforated line parallel to the first long first inner side perforated line and front and back first inner side panel margins;

a back panel connected to the first inner side panel along the second long first inner side perforated line and further defined by a long back perforated line parallel to the second long first inner side perforated line and left, right, top and bottom back panel margins;

a concealing flap attached to the top of the back panel along a back top concealing flap perforated line perpendicular to the long back perforated line;

a second inner side panel connected to the back panel along the long back perforated line, and further defined by front and back second inner side panel margins;

the first and second inner side panels having a width smaller than the first and second outer side panels so that the difference in width generally equals the thickness of a selected number of cigarettes arranged in a selected configuration; and the innerframe is adhesively attached to the cigarette box wherein the innerframe is erected and inserted into the cigarette box so that the front panel is contiguous with the front box panel, the second outer side panel is contiguous with the right side box panel, the first outer side panel is contiguous with the left side box panel, the back first inner side panel margin and the back second outer side panel margin touch the back box panel, the back second inner side panel margin and the back first outer side panel margin touch the back box panel, and the back panel is separated from the back box panel by a distance equal to the width of the first and second inner side panels.

29. The innerframe of claim 27 wherein the right and left long front perforated lines are folded to erect the first outer side panel and the second outer side panel perpendicular to the front panel, the first long first inner side perforated line is folded to erect the first inner side panel adjacent to the second folded to erect the first inner side panel adjacent to the second outer side panel, the second long first inner side perforated line is folded to erect the back panel perpendicular to the second outer side panel and the first inner side panel, the long back perforated line is folded to erect the second inner side panel perpendicular to the back panel and adjacent to the first outer side panel, the back top concealing flap perforated line is folded to erect the concealing flap perpendicular to the back panel, and the vertical first outer side panel tab perforated line and the vertical second outer side panel tab perforated line are folded to form the first tapering tab and second tapering tab, respectively.

* * * * *